US007255915B2

(12) United States Patent
Scherer

(10) Patent No.: US 7,255,915 B2
(45) Date of Patent: Aug. 14, 2007

(54) SUPPORT ELEMENT AND SUPPORT ELEMENT SYSTEM, ESPECIALLY FOR CONCRETE CONSTRUCTIONS AND CONCRETE BUILDING COMPONENTS

(76) Inventor: Josef Scherer, Alte Kantonsstrasse 16, Brunnen (CH) 6440

( * ) Notice: Subject to any disclaimer, the term of this patent is extended or adjusted under 35 U.S.C. 154(b) by 461 days.

(21) Appl. No.: 10/240,660

(22) PCT Filed: Feb. 3, 2002

(86) PCT No.: PCT/EP02/01487

§ 371 (c)(1),
(2), (4) Date: Aug. 25, 2003

(87) PCT Pub. No.: WO02/062722

PCT Pub. Date: Aug. 15, 2002

(65) Prior Publication Data

US 2004/0038015 A1 Feb. 26, 2004

(30) Foreign Application Priority Data

Feb. 5, 2001 (DE) ..... 101 05 337

(51) Int. Cl.
*B32B 17/24* (2006.01)
*B32B 13/02* (2006.01)
*E04B 1/74* (2006.01)

(52) U.S. Cl. ..... 428/294.1; 428/294.7; 52/404.1

(58) Field of Classification Search ..... 428/36.4, 428/294.1, 294.7; 264/108; 52/404.1
See application file for complete search history.

(56) References Cited

U.S. PATENT DOCUMENTS

| | | | | |
|---|---|---|---|---|
| 4,339,405 | A * | 7/1982 | Paszner | 264/108 |
| 5,631,053 | A * | 5/1997 | Andersen et al. | 428/36.4 |
| 5,851,634 | A * | 12/1998 | Andersen et al. | 428/159 |
| 6,180,037 | B1 * | 1/2001 | Andersen et al. | 264/108 |
| 6,946,506 | B2 * | 9/2005 | Bond et al. | 524/47 |
| 7,008,890 | B1 * | 3/2006 | Kunzel et al. | 442/394 |

FOREIGN PATENT DOCUMENTS

WO W0200262722 * 2/2002

* cited by examiner

*Primary Examiner*—N. Edwards
(74) *Attorney, Agent, or Firm*—Stevens, Davis, Miller & Mosher, LLP

(57) ABSTRACT

The invention relates to a support element, especially for concrete constructions and concrete building components, comprising at least one supporting fiber system embedded in a binder. The aim of the invention is to provide a support element that comprises at least one supporting fiber system embedded in a binder and that is characterized by excellent vapor permeability and at the same time by high stability and good modulus E values. To this end, the binder contains at least one polymer component that has a specific water vapor diffusion resistance value μ of at least 20000, a modulus E of transverse elasticity G of at least 3000 N/mm$^2$ and a tensile strength of at least 10 N/mm$^2$. The binder further contains at least one granular component that extends at least through parts of the supporting fiber system and that forms together with the supporting fiber system, in the cured state of the binder/polymer component, a solid body dispersoid with a water vapor diffusion resistance value μ of not more than 10000.

21 Claims, No Drawings

SUPPORT ELEMENT AND SUPPORT ELEMENT SYSTEM, ESPECIALLY FOR CONCRETE CONSTRUCTIONS AND CONCRETE BUILDING COMPONENTS

BACKGROUND OF THE INVENTION

The invention relates to a support element and a support element configuration, in particular for concrete structures and concrete structural components, the support element comprising at least one fiber support embedded in a binder. In the case of the support element configuration relating to the object of the invention, the support element has been joined to a structure or structural element by adhesion.

Support elements and support element configurations of this kind are of the state of the art, for example, in the form of sets or fabrics of high-strength fibers which are applied with a binder in layers in the tensile stress zone of a concrete surface. Use is also made of appropriately prefabricated laminates which are applied by adhesion in the tensile stress zone of a concrete surface. Such use also extends to repairs of areas of cracks and fractures in load-bearing concrete structures, but also to reinforcement of structures which are strictly speaking still intact to enable them to absorb increased loads and to new structures to ensure absorption of concentrated loads, above all, for example, in spatially reduced circumstances. In these and other applications, concrete with a more or less high moisture content is generally present in the subsoil area of laminate support elements. Water and other moistening agents may also be present, whose long-term diffusion of which in the form of corresponding vapors would not be prevented by the laminar support elements or the hardened polymer binder components of such elements.

Conventional urethane-based polymers for binders are available which have a vapor permeability adequate for the present purposes when in the hardened state. Such binders do, however, have a shear-elasticity modulus which is very low in comparison to such moduli of the high-strength fiber laminates. Consequently, in many instances the fiber strength may not be fully used, since the binder with low shear resistance between the subsoil to be relieved and the laminate fibers and between the laminate fibers themselves, limits the load transmission to the fibers to values which are too low. This applies especially to prestressed fiber configurations. On the other hand, conventional binder polymers with modulus values suitable for the purposes in question, conventional epoxy binders in particular, are characterized by virtually no vapor permeability when in the hardened state.

SUMMARY OF THE INVENTION

A first object of the invention, then, is development of a support element which comprises at least one support fiber configuration embedded in a binder and is characterized by high vapor permeability accompanied by high strength and elasticity modulus. The same applies to conglutination of subsoil and support element in relation to the additional objects of the invention. The solution claimed for attainment of the first object and additional objects of the invention is determined by the characteristics specified in the claims.

DETAILED DESCRIPTION OF THE INVENTION

In the case of the support element claimed for the invention, first a binder polymer component is assumed, one which itself has a water vapor diffusion resistance number $\mu$ of at least 20,000 when in the hardened state. This standard coefficient is a dimensionless quantity and indicates how much greater the water vapor diffusion permeability resistance of a layer of the material in question is than that of a layer of air of the same temperature at rest. Hence this is a material-specific parameter for water vapor. Consequently, it is directly authoritative for the relationships occurring in concrete engineering, but in theory—at least when considering parameter quotients for various materials—may also be used in certain cases as an approximation for kinds of vapor other than water vapor. For cured epoxy resins, for example, the $\mu$ value is around $10^5$, this in effect denoting impermeability, which renders these resins unsuitable as binders for purposes of structural reinforcement accompanied by final drying of the subsoil. On the other hand, epoxy resins have high potential as regards tensile strength and shear strength, and also as regards the shear elasticity modulus (high shear rigidity), something which makes them suitable by preference in reinforcement laminates, especially in the case of structures with high fiber pretensioning.

The advance claimed for the invention now comes into play. It is based on the finding that a composite structure of a support fiber configuration with a dispersoid binder of a polymer and a fine granulate in the viscous state worked into it permits the desired vapor permeability of the hardened composite even if the polymer is only very slightly or not at all vapor permeable. The support element claimed for the invention realizes a composite structure such as this. Practical embodiments and tests have shown that, as claimed for the invention, $\mu$ values distinctly below 10,000 have been achieved with composite support elements with high-strength fiber configurations and hardened dispersoid binders.

This applies with reproducible certainty not only in the case of binder polymer components with relatively low $\mu$ values of around 20,000 as initial material, but also in that of high-grade vapor-blocking polymers such as epoxy resins with $\mu$ values of about 75,000 and far above as initial material for the dispersoid binder.

Practical experience has surprisingly shown that relatively high upper limit values are possible for the binder-granulate components in the area of the support fiber configuration without impairing uniform and continuous working of the binder into the support fiber configuration. An upper grain size boundary value of 0.2 mm has accordingly been obtained, but it is preferable to adhere to such a value of 0.1 mm. Astounding dimensioning limits have also been found with respect to adjustment of proportions in the area of the binder granulate components configured for the support fibers relative to the polymer binder component, specifically, a portion corresponding to 35 percent by volume; for reasons of product safety, however, it may be recommended that a maximum of 15 percent by volume be adhered to, provided that the desired vapor permeability is achieved in the particular application. Certain value ranges have also been obtained with respect to optimization for the minimum portion in the area of the binder granulate components configured for the support fibers; specifically, such granulate components should not fall below a share of 7 percent by volume relative to the hardened polymer binder components, but preferably not below a minimum of 12 percent by volume.

In general mineral substances are to be considered for the binder granulate components. Those characterized by alkaline reactivity are of particular importance, however. After drying of the subsoil the alkaline granulate, in its fine distribution within the polymer binder components, comes into contact with air diffused inward from the exterior and can neutralize the carbon dioxide present in it. This contributes to maintenance of the alkaline nature in the concrete and accordingly suppression of corrosion effects on steel reinforcements in the concrete. In this connection pH values ranging from 9 to 12 are advantageous for the granulate. Binder granulates consisting at least in part of minerals of the "cement" type have proved to be highly effective both for the vapor permeability and for the alkaline reactivity in question. Such minerals should contain at least the components CaO, $SiO_2$, $Al_2O_3$, $Fe_2O_3$, or equivalent silicate forming agents.

It is important for the vapor permeability for the granulate component introduced into the binder mass in the area of the support fibers to have an open-pore structure, at least to some extent, as regards the grain surfaces. The permeability effect achieved and verified must be ascribable at least in part to the fact that the grain surfaces form a microscopic network of vapor diffusion channels which are nevertheless impermeable by liquid media because of the viscosity of the latter. In any event it is claimed for the invention that dispersoid binders possessing largely optimum combinations of properties may be prepared even by preference with highly vapor blocking epoxy resins which are yet extremely valuable from the viewpoint of strength and elasticity characteristics as binder polymer components.

It is claimed for the invention that optimization possibilities for the present application have also been created with respect to the support fiber configurations. Consequently, in addition to carbon and other high-strength fibers consideration may be given to support fiber configurations, primarily ones containing aramide fibers, preferably those containing an epoxy-based binder, permeated by a polymer binder component and a granulate binder component, and consisting at least in part of a high-strength polymer. Precisely such high-strength polymer fibers are by preference suited for preparation of support fiber configurations with strands and clusters, primarily in unidirectional configuration, but also preparation of tissues and the like with fibers or bundles of fibers twisted at least to some extent relative to each other. A configuration of the supporting elements such as this promotes uniformity of introduction of shearing stress into the individual fibers or bundle of fibers, and accordingly uniformity of distribution of stress over the cross-section of the support fiber configuration and is of importance above all in the case of prestressed configurations.

In a preferred embodiment of the support element, configurations claimed for the invention which are associated with a structure or structural component have a prestressed support fiber configuration with polymer binder components and granulate binder components, the support fiber configuration consisting at least partly of polymer fibers having a tensile strength of at least 1.2 and a tensile elasticity modulus ranging from a maximum of 150 Gpa to a minimum of 40 Gpa. In a high-grade combination of components such as this with pretensioned support fibers, specific significance is assigned to vapor permeability without impairing the long-term stability of the prestressing relationships. Especially optimal results have been obtained with structures in which the cross-section of the support fiber configuration consists at least to the extent of 15 percent of aramide fibers, which when subjected to prestressing corresponding to an elasticity minimum of 0.4 percent but maximum of 2.2 percent are shear-resistant when integrated with the subsoil. The cross-sectional component of the aramide fibers may be incresased to a minimum of 45 percent, and especially even to a minimum of 75 percent to meet extreme requirements. The respective remaining cross-section of the support fiber configuration may be occupied by fibers of a different type, for example, by ones of special deformation or flow properties, for the purpose of preparation of combined property profiles of the support element and/or of the support element configuration. By preference at least one part of the pretensioned polymer fibers extends at least in approximation parallel to a predetermined tensile load direction.

In a special support element configuration also forming part of the object of the invention, at least one support element, in particular but not mandatorily, such an element is combined with dispersoid binders, by conglutination with a structure or structural component. The conglutination element used for this purpose contains at least one polymer component which as such in the hardened state has a water vapor diffusion resistance number μ of at least 20,000, a shear elasticity modulus G of at least 5000 $N/mm^2$, and a tensile strength of at least 10 $N/mm^2$. The conglutination also contains a granulate component which forms with the polymer conglutination component a solid dispersoid with a water vapor diffusion resistance number μ of a maximum of 10,000.

It is to be regarded a distinctive feature of this configuration that the conglutination with the subsoil provided for the support element is in the form of a vapor-permeable dispersoid binder. This for practical application as well of essential significance, especially for prefabricated laminated fiber support elements to be combined with a structural component or structure in the solid state, which elements themselves may be more or less vapor-permeable, of course not necessarily as a result of use of a dispersoid binder. The passage of vapor through the support element would at the least be greatly impaired without the now available vapor permeability by means of dispersoid conglutination.

The invention claimed is:

1. A support element for concrete structures and concrete components having a support fiber configuration embedded in a binder, wherein:

the binder comprises at least one polymer component having a specific water vapor diffusion resistance number μ of at least 20,000, a shear elasticity modulus G of at least 3000 $N/mm^2$ and a tensile strength of at least 10 $N/mm^2$ when said polymer binder is in a hardened state; and the binder comprises at least one granulate component permeating the support fiber configuration and forms with the support fiber configuration a solid dispersoid with a water vapor diffusion resistance number μ of a maximum of 10,000 when said polymer binder is in the hardened state.

2. A support element as specified in claim 1, wherein the polymer binder has a water vapor diffusion resistance number μ of at least 75,000 when the polymer binder is in the hardened state.

3. A support element as specified in claim 1, wherein the granulate component has a grain size of at most 0.2 mm.

4. A support element as specified in claim 3, wherein the grain size is 0.1 mm.

5. A support element as specified in claim 1, wherein the binder comprises a maximum of 35% by volume of the granulate component relative to the polymer binder when in the hardened state.

6. A support element as specified in claim 5, wherein the binder comprises a maximum of 15% by volume of the granulate component relative to the polymer binder when in the hardened state.

7. A support element as specified in claim 1, wherein the binder comprises a minimum of 7% by volume of the granulate component relative to the polymer binder when in the hardened state.

8. A support element as specified in claim 7, wherein the binder comprises a minimum of 12% by volume of the granulate component relative to the polymer binder when in the hardened state.

9. A support element as specified in claim 1, wherein the granulate component has a pH value ranging from 9 to 12.

10. A support element as specified in claim 1, wherein granulate component comprises one or more compounds selected from the group consisting of CaO, $SiO_2$, $Al_2O_3$, $Fe_2O_3$ and silicate formers.

11. A support element as specified in claim 1, wherein the granulate component has an open pore structure in the binder.

12. A support element as specified in claim 1, wherein one of the at least one polymer component is an epoxy resin.

13. A support element as specified in claim 1, wherein the binder further comprises a high-strength polymer.

14. A support element as specified in claim 13, wherein the high-strength polymer is an aramide fiber and one of the at least one polymer component is an epoxy resin.

15. A support element as specified in claim 1, wherein the support fiber configuration comprises high strength-polymer fibers or bundles of high-strength polymer fibers twisted relative to each other.

16. A support element configuration having at least one support element as specified in claim 1 connected to a structural component, wherein the support element has a support fiber configuration comprising polymer fibers having a tensile strength of at least 1.2 Mpa and a tensile elasticity modulus ranging from 40 Gpa to 150 Gpa.

17. A support element configuration as specified in claim 16, wherein a cross-section of the support fiber configuration comprises at least 15% aramide fibers pretensioned to an elongation between a minimum of 0.4% and a maximum of 2.2% and shear-resistantly joined to a subsoil.

18. A support element configuration as specified in claim 17, wherein the support fiber configuration comprises at least 45% arainide fibers.

19. A support element configuration as specified in claim 18, wherein the support fiber configuration comprises at least 75% aramide fibers.

20. A support element configuration as specified in claim 17, wherein the aramide fibers are oriented parallel to a predetermined load direction.

21. A support element configuration as specified in claim 16 wherein each support element is joined to a structure by adhesion using an adhesion element, the adhesion element comprises at least one polymer component having a water vapor diffusion resistance number $\mu$ of at least 20,000, a shear elasticity modulus G of at least 5000 $N/mm^2$ and a tensile strength of at least 10 $N/mm^2$ when said polymer binder is in a hardened state, and the adhesion element comprises a granulate component forming a solid-dispersoid having a water vapor diffusion resistance number $\mu$ of a maximum of 10,000.

* * * * *